US005424606A

United States Patent [19]

Karasawa et al.

[11] Patent Number: 5,424,606

[45] Date of Patent: Jun. 13, 1995

[54] CATHODE ASSEMBLY AND AN ELECTRON GUN HAVING THE SAME

[75] Inventors: Jyoji Karasawa; Masataka Santoku; Daichi Imabayashi, all of Tokyo, Japan

[73] Assignee: Sony Corporation, Tokyo, Japan

[21] Appl. No.: 62,249

[22] Filed: May 17, 1993

[30] Foreign Application Priority Data

May 22, 1992 [JP] Japan ..... 4-155765

[51] Int. Cl.[6] ..... H01J 29/46

[52] U.S. Cl. ..... 313/446; 313/447; 313/409; 313/346 R

[58] Field of Search ..... 313/446, 409, 346 R, 313/447

[56] References Cited

U.S. PATENT DOCUMENTS

| | | | |
|---|---|---|---|
| 4,151,441 | 4/1979 | Puhak | 313/446 |
| 4,297,612 | 10/1981 | Anezaki | 313/446 |
| 4,500,808 | 2/1985 | McCandless | 313/447 |
| 4,558,254 | 12/1985 | Opresko | 313/446 |
| 4,607,187 | 8/1986 | Villanyi | 313/447 |
| 4,629,934 | 12/1986 | Wright | 313/447 |
| 4,631,443 | 12/1986 | Villanyi | 313/447 |
| 5,099,170 | 3/1992 | Koizumi | 313/446 |
| 5,221,875 | 6/1993 | Odenthal | 313/447 |

*Primary Examiner*—Sandra L. O'Shea
*Assistant Examiner*—Matthew J. Esserman
*Attorney, Agent, or Firm*—Jay H. Maioli

[57] ABSTRACT

In a cathode assembly of a cathode ray tube, a cathode having an emitter is inserted in a through-hole formed in an insulator. The emitter is provided so as to face a cylindrical electrode of a first grid at a predetermined distance. A hole communicating with the through-hole is formed at a longitudinal side of the insulator, and a tubularly rising shelter is provided between the emitter in the through-hole of the insulator and the hole. This satisfies $(E\times B)-(C\times E)+(C\times D)-(A\times D)\geqq A.\ D$, where the height of the hole is A, the height of the shelter is B, the length from the lower end of the shelter to the head of the cathode is C, the length between the cathode and the shelter is D, and the length between the cathode and the insulator is E. The cathode assembly prevents metal vapor, such as barium oxide of the cathode and nickel or chromium of the sleeve, from spreading through the hole of the insulator.

6 Claims, 5 Drawing Sheets

CATHODE ASSEMBLY AND AN ELECTRON GUN HAVING THE SAME

BACKGROUND OF THE INVENTION

1. Field of the Invention

The present invention relates to a cathode assembly used in an electron gun of a picture tube, and more particularly, is an invention for preventing the spread of metal vapor produced from near an emitter to a hole in a cylindrical insulator.

2. Description of the Related Art

The picture tube used in a television receiver is called a Braun tube or a CRT (cathode ray tube). An electron gun and a phosphor screen are sealed in a funnel shaped glass tube (glass envelope).

The cathode assembly constituting the electron gun has the cathode inserted in the through-hole of the cylindrical insulator such as ceramic, in a state supported by the sleeve holder. The emitter attached to the front end of the cathode is affixed, at a predetermined distance relative to the cylindrical electrode of the first grid provided on the cylindrical insulator such as ceramic. Further, by heating and activating the emitter, hot electrons are emitted. The electron beam is accelerated and controlled to converge by a plurality of cylindrical electrodes, including the first grid and the second grid.

When the cathode assembly is operated and made to emit hot electrons, the oxide constituting the emitter is decomposed and gas is produced. While the glass envelope where the cathode assembly is provided is maintained at a high vacuum state, the degree of vacuum inside the through-hole of the cylindrical insulator locally falls due to the gas produced at the time of the activation of the oxide, so holes are opened in the cylindrical insulator. Due to the provision of the holes, the gas produced in the through-hole can be made to disperse inside the glass envelope and the hot electrons can be suitably emitted.

However, since the cathode is operated at a high temperature of close to 1000° C., the metal cylinder (hereinafter referred to as the "sleeve") constituting the cathode is heated and therefore metal vapor is produced. Further, this metal vapor spreads to the outside of the cathode assembly from the holes opened in the cylindrical insulator. It deposits on the cylindrical insulator of the other adjoining cathode assembly.

In this way, if the metal vapor spread from the holes deposits on the outer surface of an insulator such as ceramic, there is a danger of conduction between the sleeve holder supporting the cathode and the cylindrical electrode of the first grid etc. or the spacer provided between the sleeve holder and the cylindrical electrode and therefore the function of the electron gun is impaired.

It is true that if the holes are not made in the long side of the cylindrical insulator, but made in the short side, the spreading of the metal vapor from the holes will not become a cause of leakage, but with this structure, it is not possible to ensure a sufficient area of the opening of the holes and further the strength of the cylindrical insulator is lowered, so this is not practical.

SUMMARY OF THE INVENTION

The present invention has been made in consideration of the above problems in the prior art and has as its object the prevention of spreading of the metal vapor, such as barium oxide of the cathode and nickel or chromium of the sleeve, through the holes of the cylindrical insulator.

To achieve the above objects, the cathode assembly of the present invention comprises a cylindrical insulator having a hole; a cathode surrounded by the insulator and having a metal portion; and a shelter provided between the hole and the cathode for preventing the metal vapor from spreading through the hole.

Further, to achieve the above objects, the electron gun of the present invention comprises a cathode assembly comprising a cylindrical insulator having a hole; a cathode surrounded with the insulator and having a metal; a shelter provided between the hole and the cathode for preventing the metal vapor from spreading through the hole; and a plurality of grids.

Preferably, it satisfies $$(E\times B)-(C\times E)+(C\times D)\geqq(A\times D)$$

wherein the height of the hole is A, the height of the shelter is B, the length from the lower end of the shelter to the head of the cathode is C, the length between the cathode and the shelter is D, and the length between the cathode and the insulator is E.

When the cathode having the emitter is actuated, the oxide is activated and hot electrons are emitted. At the same time as this, the sleeve is also heated to a high temperature and metal vapor is produced. This metal vapor tries to spread outside from the hole of the cylindrical insulator, but with the cathode assembly of the present invention, a shelter is provided between the emitter and the hole, so the metal vapor is stopped by the shelter and will not spread outside.

In particular, since the cathode assembly is set to a high vacuum state, the metal vapor spreads linearly and therefore if the cathode assembly is constituted so that when the height of the hole is A, the height of the shelter is B, the length from the lower end of the shelter to the head of the cathode is C, the length between the cathode and the shelter is D, and the length between the cathode and the insulator is E, the following equation is satisfied:

$$(E\times B)-(C\times E)+(C\times D)\geqq(a\times D)$$

the metal vapor will be completely stopped by the shelter.

BRIEF DESCRIPTION OF THE DRAWINGS

The above-mentioned objects and features of the present invention will become clearer by the following description, given in relation to the accompanying drawings, wherein.

DESCRIPTION OF THE PREFERRED EMBODIMENTS

Below, an embodiment of the present invention will be explained based on the drawings.

Figure 1:
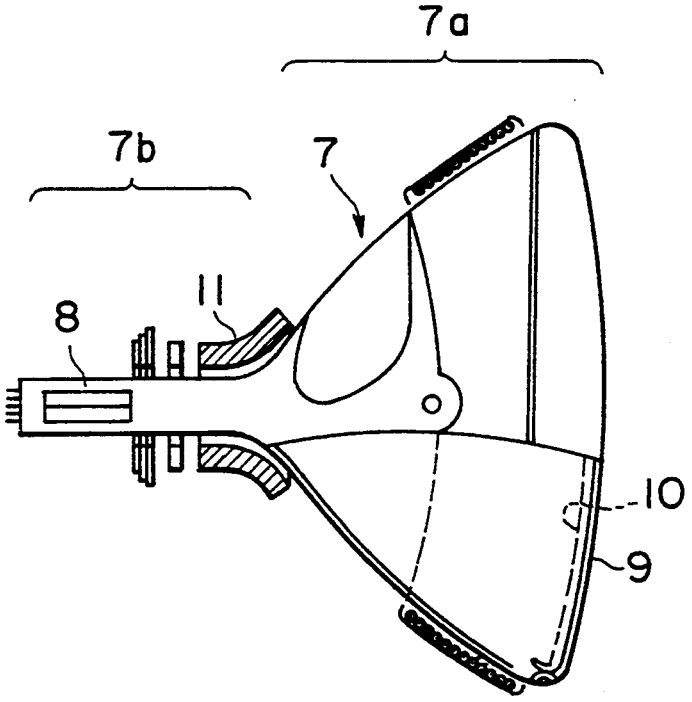
FIG. 1 is a side view of a picture tube of a television receiver according to an embodiment of the present invention.

The picture tube used in a television receiver is called a Braun tube or a CRT (cathode ray tube). As shown in FIG. 1, an electron gun 8 and a phosphor screen 9 are sealed in a funnel shaped glass tube (glass envelope).

The glass envelope 7 comprises a cone portion *7a* which flares outward and a thin cylindrical neck portion *7b* as shown in the figure. At the bottom of the cone portion *7a* a phosphor is coated. The entire unit is evacuated to a vacuum. In the case of a color picture tube, three electron guns are provided in the glass envelope 7. Further, a shadow mask 10 is provided before the phosphor screen 9 so as to select the electron beams of the different colors.

On the other hand, the electron gun 8 comprises cathode assemblies for emitting electrons and a plurality of cylindrical electrodes for bundling the flow of electrons into the electron beam, accelerating this to a high speed, and making it converge on the phosphor screen. In the case of a color picture tube, for example, the three electron beams emitted, controlled, accelerated, and converged from the electron guns 8 are deflected by a deflection yoke 11 to scan the entire surface of the phosphor screen 9.

The deflection yoke 11 consists of a pair of coils: a horizontal deflection coil and a vertical deflection coil. For example, the horizontal deflection coil is wound on the inside and the vertical deflection coil is wound on the outside. In particular, with an in-line picture tube used for home television receivers (a picture tube with three electron guns arranged in a lateral line, used for color televisions), wide use is made of an in-line yoke having a horizontal deflection magnetic field of a pincushion shape and a vertical deflection magnetic field of a barrel shape. This corrects the shape of the rasters and improves the precision of the convergence.

Figure 2A:
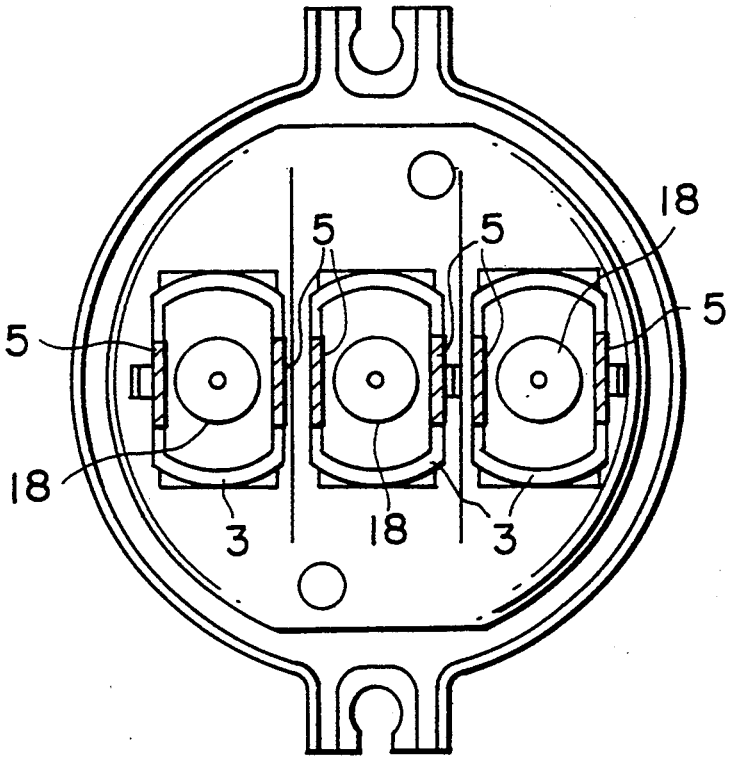
FIG. 2A is a bottom view of a cathode assembly according to an embodiment of the present invention.
Figure 2B:
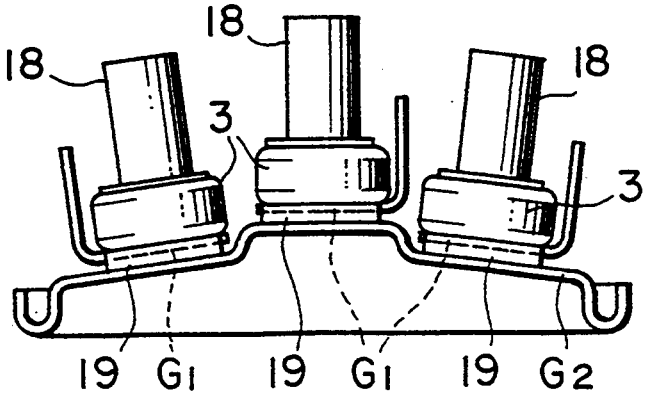
FIG. 2B is a side view of the same.

The cathode assembly constituting the electron gun 8, as shown in FIG. 2A and FIG. 2B, has the cathode inserted in the through-hole of the cylindrical insulator 3 such as ceramic, in a state supported by the sleeve holder 18. The emitter attached to the front end of the cathode is affixed, at a predetermined distance relative to the cylindrical electrode of the first grid G1 provided on the cylindrical insulator 3 such as ceramic. Further, by heating and activating the emitter, hot electrons are emitted. The electron beam is accelerated and controlled to converge by a plurality of cylindrical electrodes, including the first grid G1 and the second grid G2.

Figure 3A:
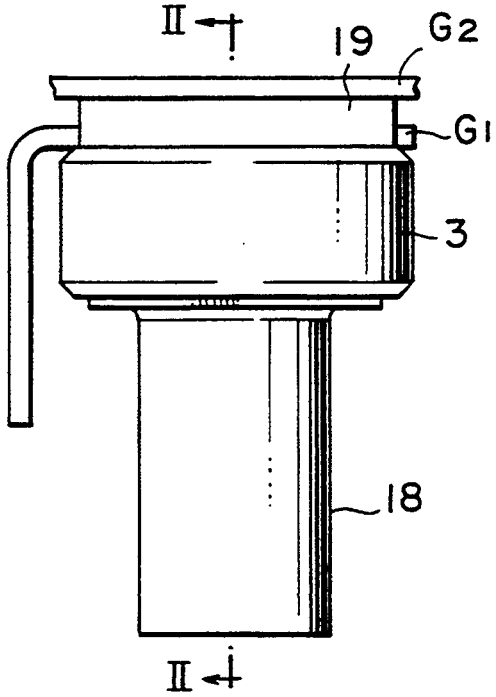
FIG. 3A is a side view of a cathode assembly according to an embodiment of the present invention.
Figure 3B:
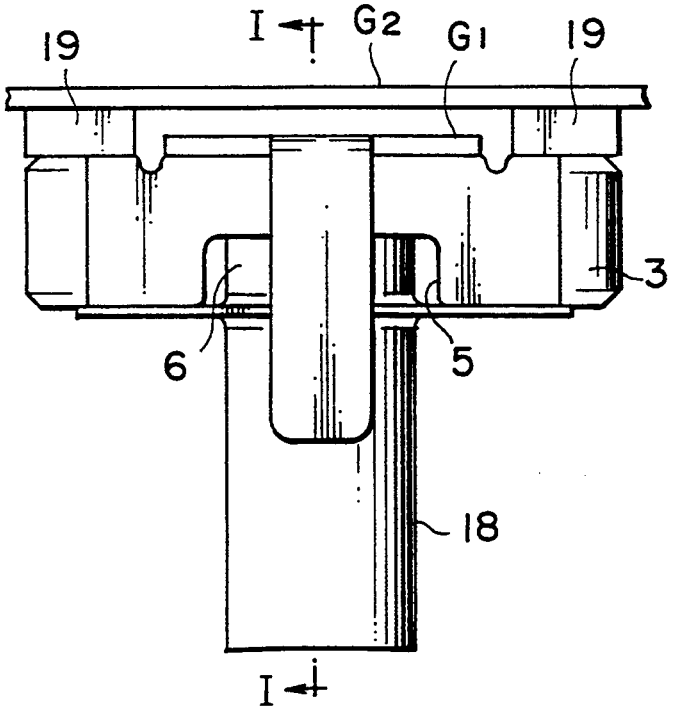
FIG.3B is a front view of the same.

When the cathode assembly is operated and made to emit hot electrons, the oxide constituting the emitter is decomposed and gas is produced. While the glass envelope where the cathode assembly is provided is maintained at a high vacuum state, the degree of vacuum inside the through-hole of the cylindrical insulator locally falls due to the gas produced at the time of the activation of the oxide, so holes 5 shown in FIG. 2A and FIG. 3B are opened in the cylindrical insulator 3. Due to the provision of the holes 5, the gas produced in the through-hole can be made to disperse inside the glass envelope and the hot electrons can be suitably emitted.

Figure 4A:
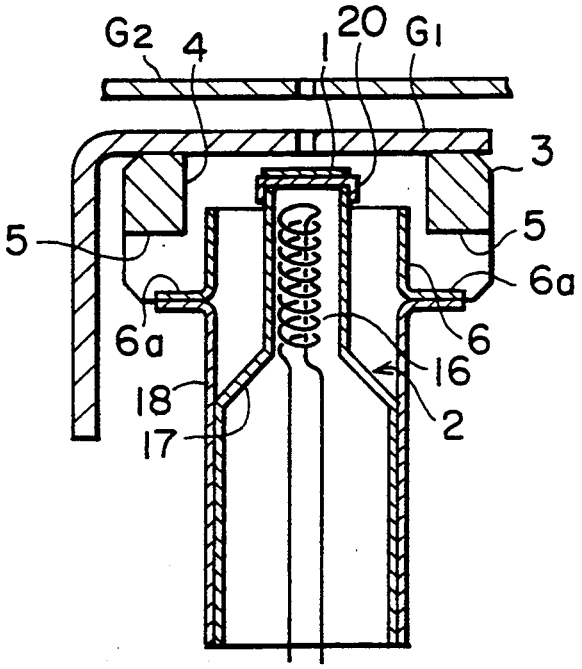
FIG. 4A is a sectional view along the line I—I of FIG. 3B.
Figure 4B:
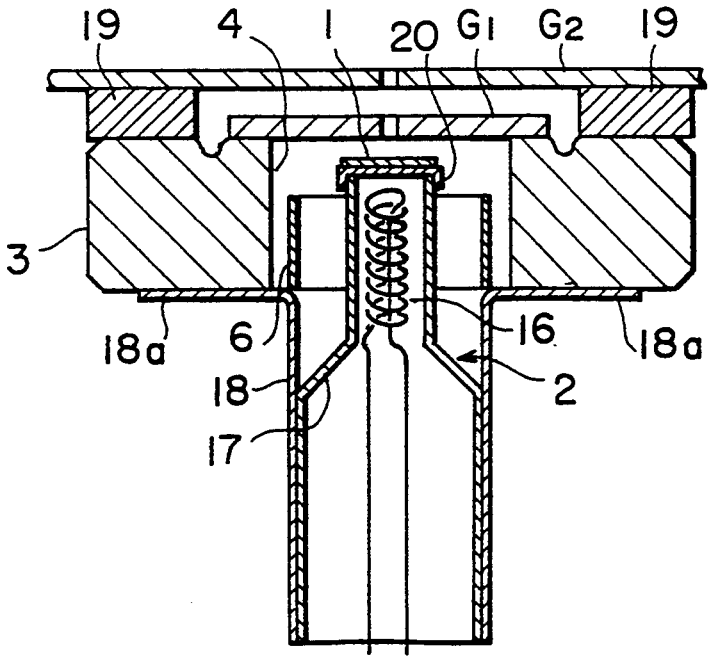
FIG. 4B is a sectional view along line II—II of FIG. 3A.

As shown in FIG. 4A and FIG. 4B, the cathode assembly of the present embodiment has a cathode 2, which cathode 2 comprises of an emitter 1 which emits hot electrons and a sleeve 17 provided with the heater 16 inside it. The sleeve 17 is a substantially cylindrical metal body having a large diameter portion and a small diameter portion. At the front end is attached an emitter 1 through a cap 20.

For example, the emitter 1 is coated with an oxide composed principally of barium oxide. The emitter 1 is heated at temperatures on the order of 750° to 800° C. by the heater, and activated and emits hot electrons.

To affix the sleeve 17 having the emitter 1 and the heater 16 to the cylindrical insulator 3 such as ceramic, a sleeve holder 18 is welded to the insulator 3. The sleeve holder 18 is a tubular metal body formed with a flange 18a as a welding margin. It is formed to an inner diameter corresponding to the outer diameter of the large diameter portion of the sleeve 17 and is inserted over the sleeve 17 and affixed by welding etc.

On the other hand, the cylindrical insulator 3 has a through-hole 4 opened in the axial direction of the sleeve 17. At the top surface of the through-hole 4 is soldered a cylindrical electrode constituting the first grid G1. Further, at the cylindrical insulator 3 at the outer circumference of the first grid G1 is soldered a spacer 19 for ensuring a distance from a second grid G2. At the top surface of the spacer 19 is attached a cylindrical electrode constituting the second grid G2 by laser welding, for example.

In the cylindrical insulator 3 such as ceramic, there are formed holes 5 at the long side thereof as shown in FIG. 2A, FIG. 3B and FIG. 4A so as to discharge to the outside the gas produced when the emitter 1 is activated. The holes 5 communicate with the above-mentioned through-hole 4.

Usually, the inside of the glass envelope of the television receiver having the cathode assembly is held at a high vacuum state, so it is preferable to open large holes 5 in the cylindrical insulator 3 to discharge the gas of the oxide produced in the through-hole 4 of the insulator 3 to the outside, that is, in the glass envelope. However, the insulator must have a thickness more than 0.5 mm, and if the holes 5 are set to large openings, the strength of the insulator 3 falls, so it is preferable to set the openings in a range in which the strength can be ensured.

Further, as mentioned above, to activate the emitter 1 such as oxide, it is necessary to heat it to a high temperature close to 1000° C. by the heater 16, so the sleeve 17 accommodating the heater 16 is also heated at a high temperature at the same time as the operation of the cathode 2. Due to this heating, metal constituting the sleeve 17 is vaporized and becomes a vapor which spreads outside.

In the present embodiment, a shelter 6 is provided inside the through-hole 4 of the cylindrical insulator 3 so that the metal vapor does not spread outside. The shelter 6 is made of an alloy including cobalt, iron, and nickel having a composition of 29% Nickel, 18% Cobalt and the remainder is Iron and has a thickness of 50 μm. As shown in FIGS. 4A and 4B, it comprises a tubular metal body which has a flange 6a for welding to the sleeve holder 18 and rises along the axial direction of the cathode 2. The shelter 6 is attached to the sleeve holder 18 by aligning and welding the flange 18a of the sleeve holder 18 and the flange 6a of the shelter 6 after or before attachment of the cathode 2 to the sleeve holder 18 and is attached to the cylindrical insulator 3 in that state.

Figure 5:
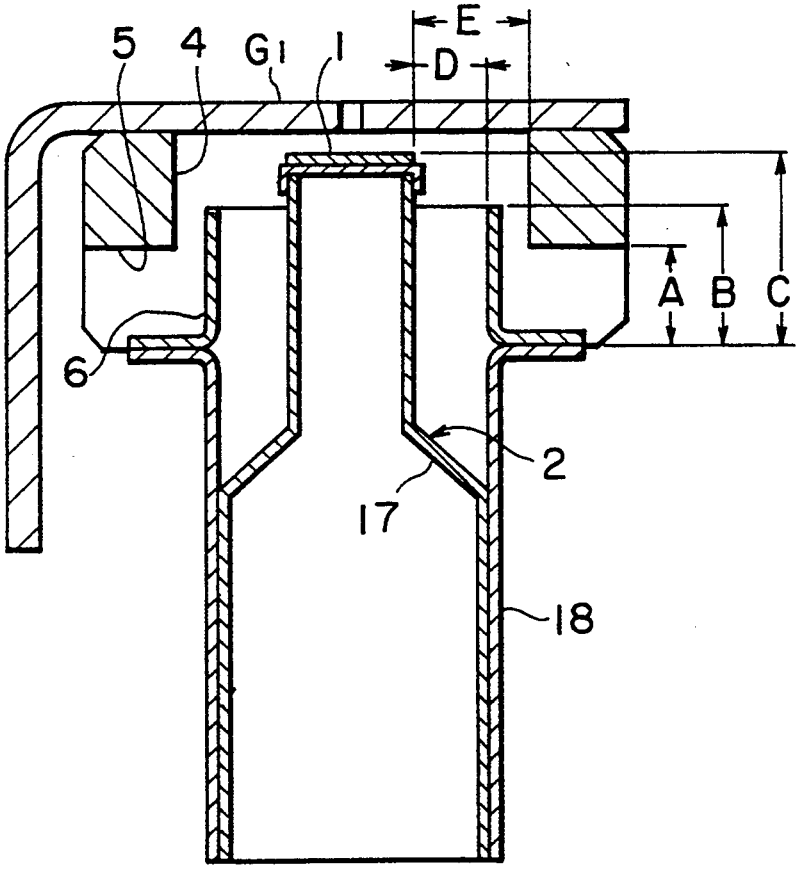
FIG. 5 is an enlarged sectional view of FIG. 4A, which sectional view explains the dimensional conditions of the shelter.

In particular, since the inside of the glass envelope of the television picture tube with the cathode assembly is in a high vacuum state, the metal vapor spreads linearly. Based on this point of view, in the present embodiment, the relationship between the height B (=1.2 mm) of shelter 6, the height A (=0.6 mm; because of the manufacturing error and the strength of the insulator although calculation is A≦1) of the hole 5, the length C (=1.5 mm) from lower end of the shelter 6 to head of the cathode 2, the length D (=0.3 mm) between the cathode 2 and the shelter 6, and the length E (=0.5 mm) between the cathode 2 and the insulator 3 (as shown in FIG. 5) is set as shown in the following equation (1):

$$(E\times B)-(C\times E)+(C\times D)\geqq(A\times D) \quad (1)$$

When there are manufacturing errors and other tolerances in the height B of the shelter, the height A of the hole, the length C from the lower end of the shelter to the head of the cathode, the length D between the cathode and the shelter, and the length E between the cathode and the insulator, the following equation (2) is preferable.

That is, owing to the manufacturing errors and other tolerances of each part constituting the cathode assembly, $$(E_{MAX}\times B_{MIN})-(C_{MAX}\times E_{MAX})+(C_{MAX}\times D_{MIN})\geqq(A_{MAX}\times D_{MIN}) \quad (2)$$

wherein, the minimum value of the height B of the shelter is $B_{MIN}$, the maximum value of the height A of the hole is $A_{MAX}$, the maximum value of the length C from the lower end of the shelter to the head of the cathode is $C_{MAX}$, the minimum value of the length D between the cathode and the shelter is $D_{MIN}$, and the maximum value of the length E between the cathode and the insulator is $E_{MAX}$.

If the shelter 6 is formed at a height greater than $B_{MIN}$ satisfying this equation (2), then the metal vapor spreading from near the emitter can be completely stopped by the shelter 6.

Next, the mode of operation will be explained.

If the cathode 2 having the emitter 1 is actuated, the oxide is activated and hot electrons are emitted. At the same time as this, the sleeve 17 is also heated to a high temperature and metal vapor is produced. This metal vapor tries to spread outside from the hole of the cylindrical insulator 3, but with the cathode assembly of the present invention, since the tubularly rising shelter 6 is provided between the emitter 1 and the holes 5, the metal vapor is stopped by the shelter 6 and will not spread outside.

In particular, since the cathode assembly is set to a high vacuum state, the metal vapor spreads linearly and therefore if the cathode assembly is constituted so that when the height of the hole is A, the height of the shelter is B, the length from the lower end of the shelter to the head of the cathode is C, the length between the cathode and the shelter is D, and the length between the cathode and the insulator is E, the following equation is satisfied:

$$(E\times B)-(C\times E)+(C\times D)\geqq(A\times D)$$

the metal vapor will be completely stopped by the shelter 6.

In this way, with the cathode assembly of the present embodiment, since provision is made of a shelter in the through-hole of the cylindrical insulator and the dimensional relationship between the height A of the hole, the height B of the shelter, the length C from the lower end of the shelter to the head of the cathode, the length D between the cathode and the shelter, and the length E between the cathode and the insulator satisfies equation (1) or equation (2), the spreading of the metal vapor of the sleeve produced from the cathode to the hole of the cylindrical insulator is stopped by the shelter.

Therefore, no leakage occurs between the sleeve holder 18 supporting the cathode and the cylindrical electrode of the first grid G1 etc. or the spacer 19 provided between the sleeve holder 18 and the cylindrical electrode.

Many widely different embodiments of the present invention may be constructed without departing from the spirit and scope of the present invention, and it should be understood that the present invention is not restricted to the specific embodiments described above.

What is claimed is:

1. A cathode assembly comprising:

a cylindrical insulator formed with a hole;

a cathode surrounded by the insulator and having a metal portion; and a shelter provided between the insulator and the cathode, such that the insulator, the cathode and the shelter have a positional relationship for preventing metal evaporated from the metal portion of the cathode from spreading through the hole, where said cathode has a head, said shelter has a lower end and said positional relationship satisfies the following formula:

$$(E\times B)-(C\times E)+(C\times D)\geqq(A\times D)$$

in which

A defines a height of the hole:

B defines a height of the shelter:

C defines a length from the lower end of the shelter to the height of the cathode;

D defines a length between the cathode and the shelter; and

E defines a length between the cathode and the insulator.

2. A cathode assembly as recited in claim 1 wherein said shelter comprises an alloy including at least cobalt, iron, and nickel elements.

3. A cathode assembly as recited in claim 1 wherein said insulator is formed of a material comprising a ceramic.

4. An electron gun comprising:

a cathode assembly comprising:

a cylindrical insulator formed with a hole;

a cathode surrounded by the insulator and having a metal portion;

a shelter provided between the insulator and the cathode such that the insulator, the cathode and the shelter have a positional relationship for preventing metal evaporated from the metal portion of the cathode from spreading through the hole; and a plurality of grids for assisting in controlling an electron beam generated by said cathode assembly, wherein said cathode has a head, said shelter has a lower end and said positional relationship satisfies the following formula:

$$(E\times B)-(C\times E)+(C\times D)\geqq(A\times D)$$

in which

A defines a height of the hole;

B defines a height of the shelter;

C defines a length from the lower end of the shelter to the head of the cathode;

D defines a length between the cathode and the shelter; and

E defines a length between the cathode and the insulator.

5. An electron gun as recited in claim 4 wherein said shelter comprises an alloy including at least cobalt, iron, and nickel elements.

6. An electron gun as recited in claim 4 wherein said insulator is formed of a material comprising a ceramic.

* * * * *